US005370288A

United States Patent [19]

Field

[11] Patent Number: 5,370,288

[45] Date of Patent: Dec. 6, 1994

[54] ADJUSTABLE LOOP-TYPE HOLDER

[76] Inventor: Bradley J. Field, 585 Gaston Avenue, Kelowna, British Columbia, Canada, V1Y 7E6

[21] Appl. No.: 68,260

[22] Filed: May 27, 1993

[51] Int. Cl.[5] ..... A45F 5/00; A45F 3/00

[52] U.S. Cl. ..... 224/223; 224/256; 224/251; 24/10 R; 248/309.1; 211/60.1

[58] Field of Search ..... 224/223, 203, 255, 256, 224/251; 24/10 R; 248/309.1; 211/60.1

[56] References Cited

U.S. PATENT DOCUMENTS

| | | | |
|---|---|---|---|
| 1,085,451 | 1/1914 | Lynch | 224/223 |
| 1,991,306 | 2/1935 | Woolsey . | |
| 4,069,954 | 1/1978 | Rauch | 224/223 X |
| 4,523,702 | 6/1985 | Viio . | |
| 4,613,068 | 9/1986 | Bianchi | 224/203 X |
| 4,836,427 | 6/1989 | McManus | 224/224 |
| 4,993,614 | 2/1991 | Bonofiglio | 224/253 |
| 5,199,621 | 4/1993 | McLennan | 224/253 |

*Primary Examiner*—Ernest G. Cusick

*Attorney, Agent, or Firm*—Chernoff, Vilhauer, McClung & Stenzel

[57] ABSTRACT

An article holder having adjustable loops comprises a foundation piece having a slot therein for receiving a looped strip of flexible material therethrough and locking structure comprising a member having greater width than the slot, positionable beneath the slot, for frictional engagement with the looped strip and through the looped strip when the member is beneath the slot.

23 Claims, 6 Drawing Sheets

ADJUSTABLE LOOP-TYPE HOLDER

FIELD OF THE INVENTION

This invention relates to article holders which hold articles within loops of flexible and, commonly, resilient material so as to hold the articles against a substrate, commonly a stiff plate or cloth or like semi-rigid bearing surface.

BACKGROUND OF THE INVENTION

A typical method of providing holders for cylindrical and like articles in luggage, toiletry bags, brief-cases softsided medical kits or on tool or ammunition belts or pouches is to employ a strip of cloth, sometimes elasticized, and embroider or otherwise affix at intervals the strip of cloth to the surface of the luggage, toiletry bag, etc. so as to form loops in the strip of cloth. The size of the loop will determine the size of the article that can be held within the loop, the use of elasticized cloth adding a degree of accommodation as to the size of the article which may be held in the loop. Typically, the use to which the article holder is intended will dictate the size of the loop formed in the strip of cloth. This is most often done at the point of manufacture of the luggage, toiletry bag, etc.

For example, medical kits used by para-medics and like emergency attendants are often very specialized in the equipment they provide, depending on the particular trauma they are being called on to treat. Kits having pre-formed loops thus must be manufactured to address specific needs such as intravenous administration, intubation and airway management, or ampoule and vial medication storage and administration. A second example are ammunition holders on hunter's clothing or on police body armour. Vests and body armour having pre-formed loops for holding ammunition must have a variety of different sized loops to accommodate different sized ammunition such as shotgun shells and rifle rounds. This limits the quantity of any one size of ammunition that can be carried.

It is often desirable to be able to re-size the loops after the medical kit, article of hunter's clothing, luggage, toiletry bag, etc. is manufactured to accommodate different sized articles. That is, it is desirable for the end-user to be able to customize the uses to which the manufactured product may be put. Various devices have been proposed to accomplish this.

U.S. Pat. No. 1,991,306 entitled "Article Holder" which issued to Cora Woolsey on Feb. 12, 1935, discloses an article holder in which an elastic strap is threaded or laced through a series of holes or slits in a single layer foundation piece.

U.S. Pat. No. 4,523,702 entitled "Tool Holder" which issued to Matti Viio on Jun. 18, 1985, discloses a tool holder which can be adapted by the end-user to provide elastic loops of varying size. The Viio device utilizes a single layer plate in which rows of slots are provided. Flexible straps are threaded through selected pairs of closely spaced slots. Stop means may be provided to prevent unintentional slipping of the straps in their respective slots.

It has been found that merely threading strapping through a single layer plate, foundation or semi-rigid bearing surface does not always prevent the strap from slipping. If the strapping slips this may unintentionally change the size of the loops, especially if the strapping is of resilient elastic material.

SUMMARY OF THE INVENTION

The present invention provides an adjustable elastic strap, or other resilient material, loop-type holder for holding articles in which the loop size can be altered and locked at the correct size to suit individual requirements so that articles may be firmly held within the loops against a bearing surface such as a semi-rigid foundation piece.

In order to work in an interchangeable modular fashion, a foundation piece for supporting such lockable adjustable loops of strapping has to be self-contained and provide a substrate through which the elastic strapping or webbing can be threaded so as to releasably lock the strapping or webbing in place once a desired loop size is set.

The foundation piece of one embodiment of the present invention has three layers. Top and bottom layers of semi-rigid material sandwich an intermediate layer of similar material, the intermediate layer having cut-outs so as to form voids between the upper and bottom layers. The bottom layer also has a portion cut-away, that portion being smaller than the portion of the intermediate layer cut-away. The cut-away in the bottom layer provides access to the voids formed in the intermediate layer between the upper and the bottom layers.

The voids formed in the intermediate layer extend along the length of the intermediate layer and are shaped so as to snugly receive therein correspondingly sized fingers of like semi-rigid material, advantageously cut from the same material as the intermediate layer, the fingers insertable through the bottom layer cut-out into snug mating engagement in the corresponding voids in the intermediate layer. The voids are shaped so as to accept in mating engagement the fingers when inserted transversely therein. An array of such voids are spaced along the length of the intermediate layer.

The upper layer along its' length has an array of transverse slots cut therein, each slot corresponding in vertical alignment to one of the transversely aligned voids in the intermediate layer so that when a finger is inserted into mating engagement in a void in the intermediate layer, a corresponding slot in the upper layer is aligned directly above and generally bisects the finger along its length.

The three layers are formed into a single foundation unit, for example by stitching around the circumference of the layers, and with the fingers removed, elastic strapping or like resilient webbing may be doubled over and inserted through the slots in the upper layer so as to form loops extending downwardly from the slots and through the cut-out in the intermediate layer. Fingers may then be threaded through the loops which extend through the cut-out in the intermediate layer and inserted into snug mating engagement with the voids in the intermediate layer, one finger being inserted through each loop. The finger for any particular loop is mated with the voids in the intermediate layer corresponding to a corresponding slot in the upper layer, that is, the slot generally vertically aligned with that particular pair of voids in the intermediate layer. With the fingers mated into the intermediate layer and the excess in the loops taken up, loops are formed which extend upwards from the upper layer and which are of a size which has been adjusted and releasably locked into place by mating of the fingers, hereinafter "finger locking devices", into the intermediate layer.

Affixed along the underside of the bottom layer are strips of conventional hook and loop-type fasteners such as Velcro (TM) which enable the foundation piece and strapping, once the strapping has been adjusted and the finger locking devices inserted, to be detachably removed from any underlying surface having corresponding strips of hook and loop-type fastening material without disturbing the adjustment of the loops. Thus the adjustable loop-type holder of the present invention may be used in a modular fashion. That is, foundation pieces having pre-adjusted loops of one particular size may be substituted for similar foundation pieces having pre-adjusted loops of a different size and specific to a different use, so that the underlying surface (such as a medical kit or a piece of hunter's clothing) may be quickly re-configured to hold different articles merely by switching the foundation pieces.

BRIEF DESCRIPTION OF THE DRAWINGS

In drawings which depict preferred embodiments of the invention.

DETAILED DESCRIPTION OF A PREFERRED EMBODIMENT

Figure 1:
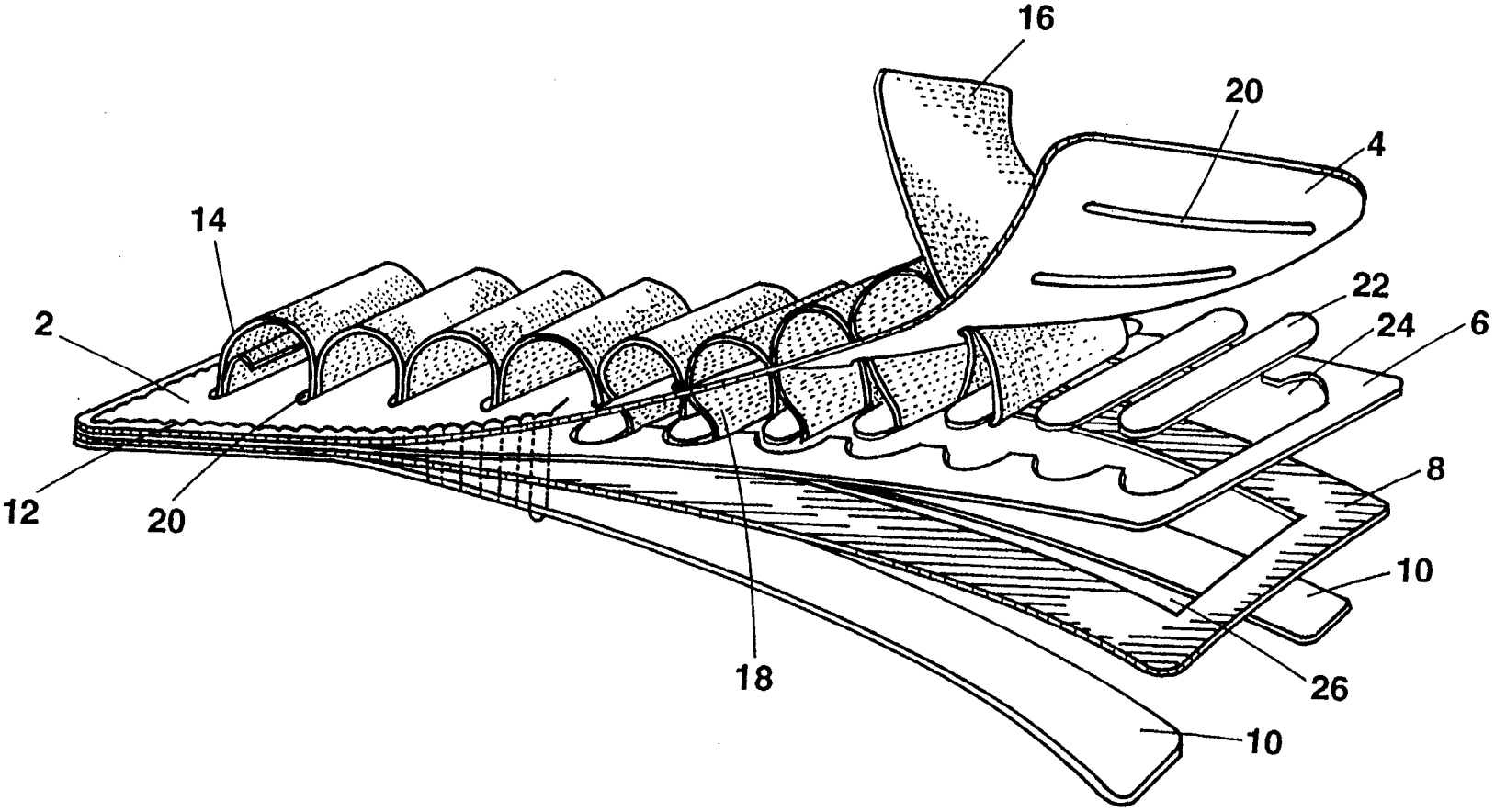
FIG. 1 is a partially exploded perspective view of the adjustable loop-type holder of the present invention.

As illustrated in FIG. 1, foundation 2 is comprised of upper layer 4, intermediate layer 6, bottom layer 8, and affixed to the undermost surface of bottom layer 8, strips of conventional hook and loop-type fasteners such as Velcro (TM) 10. Layers 4, 6 and 8, and strips 10 are joined together, for example by circumferential stitching 12 so as to form a unified foundation providing a bearing surface against which articles may be held by inserting articles into upper loops 14 formed of elastic or otherwise resilient strapping or webbing 16.

Upper loops 14 are formed in webbing 16 by doubling over segments of webbing 16 and inserting the doubled over segments through slots 20 in upper layer 4 so as to form lower loops 18. Finger locking devices 22 are inserted through lower loops 18. Each of the ends of finger locking devices 22, once inserted through lower loops 18 (one device 22 for each loop 18), are mated into correspondingly shaped pairs of voids 24 formed in the void between upper layer 4 and bottom layer 8 created by having portions of intermediate layer 6 in the shape of finger locking devices 22 cut out from the material forming intermediate layer 6.

Intermediate layer 6 and finger locking devices 22 are made of a semi-rigid material, for example, Duraflex (TM) high-density polyethylene. Duraflex (TM) material having a thickness of 0.55 thousandths of an inch provides suitable intermediate layer 6 and finger locking devices 22. The purpose of finger locking devices 22 is to provide friction bearing surfaces around which webbing 16 must turn so that when webbing 16 is tightened by pulling the webbing forming lower loops 18 back up through slots 20, finger locking devices 22 are snugged up underneath upper layer 4 and held in place by snug mating engagement of the ends of the finger locking devices in voids 24. Advantageously, finger locking devices 22 and intermediate layer 6 are of similar thickness. Finger locking devices 22 must be rigid enough to provide friction bearing surfaces around which webbing 16 is wrapped, and yet be flexible enough so that finger locking devices 22 may be momentarily bowed so as to insert their ends into voids 24. Access to voids 24 in intermediate layer 6 is through a hole cut from bottom layer 8. As depicted in FIG. 1, the hole may be in the form of rectangular aperture 26.

Aperture 26 is large enough to provide access to voids 24 and yet must not be so large as to not leave remaining material of bottom layer 8 sufficiently large to form the bottom-most side of the enclosure forming voids 24 (upper layer 4 framing the upper side of voids 24).

Figure 2:
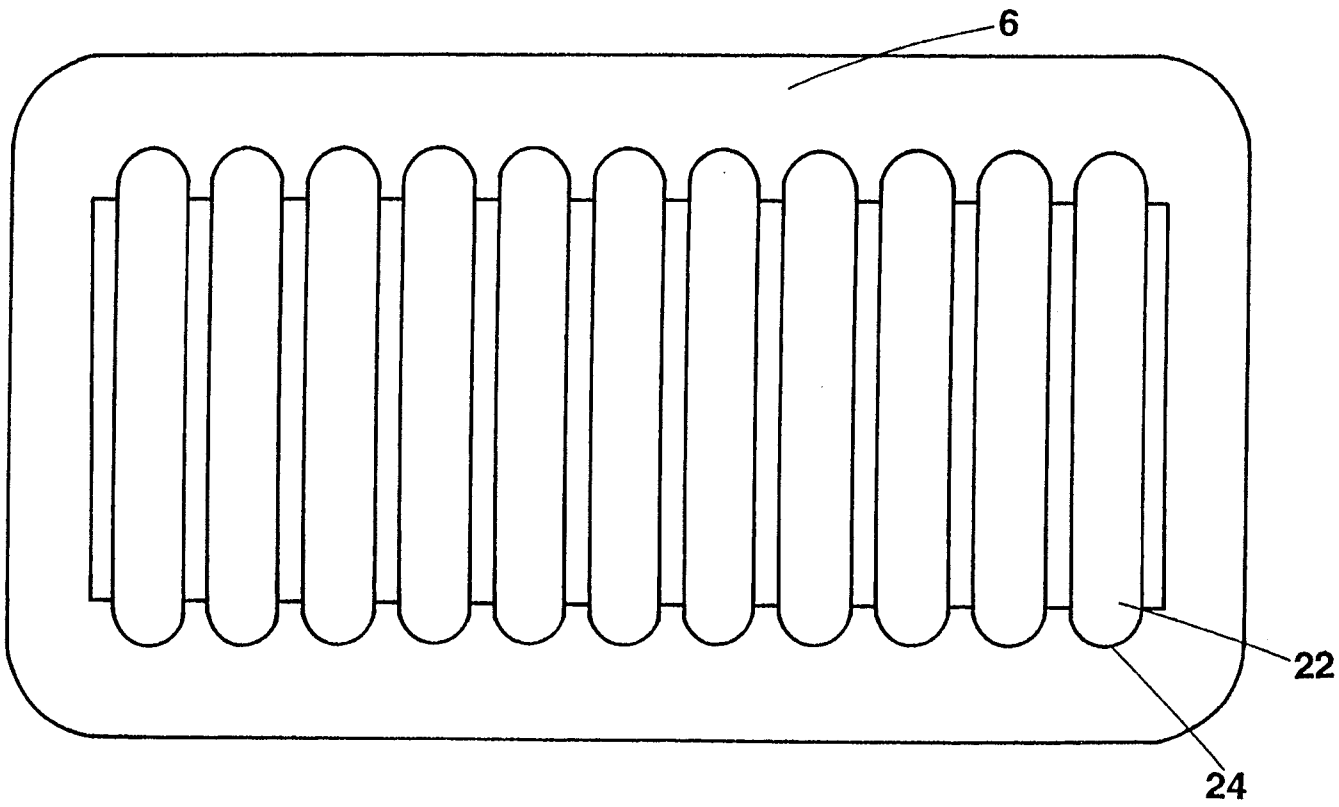
FIG. 2 is, in plan view, an intermediate layer of the foundation of the present invention.

In FIG. 2 intermediate layer 6 is illustrated in plan view with finger locking devices 22 inserted and snugly mated into voids 24.

Figure 3:
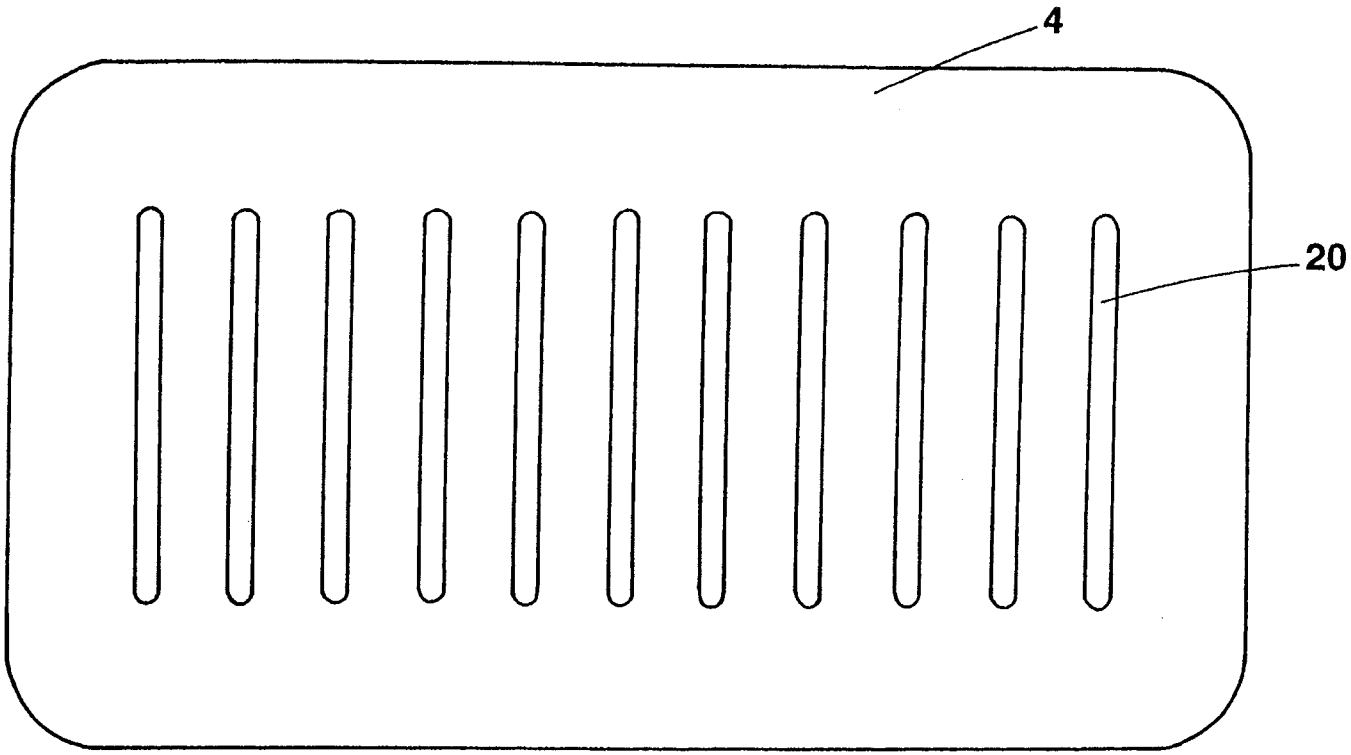
FIG. 3 is, in plan view, the upper layer of the foundation of the present invention.

FIG. 3 illustrates in plan view upper layer 4 showing the array of lateral slots 20. When upper layer 4 is superimposed over intermediate layer 6 the array of lateral slots 20, as depicted in FIG. 3, overlay and generally bisect along their length corresponding finger locking devices 22 in the array of laterally oriented finger locking devices 22 illustrated in FIG. 2. It has been found that a ratio of the width of slots 20 to the width of finger locking devices 22 of approximately 1 to 4 (1:4), as depicted in FIGS. 2 and 3, forces webbing 16 to be folded sufficiently when installed as depicted in FIG. 1 so as to substantially prevent webbing 16 slipping by the insertion of articles into loops 14 once loops 14 have been locked into position by mating finger locking devices through lower loops 18 and into voids 24 and loops 18 tightened around finger locking devices 22.

Figure 4:
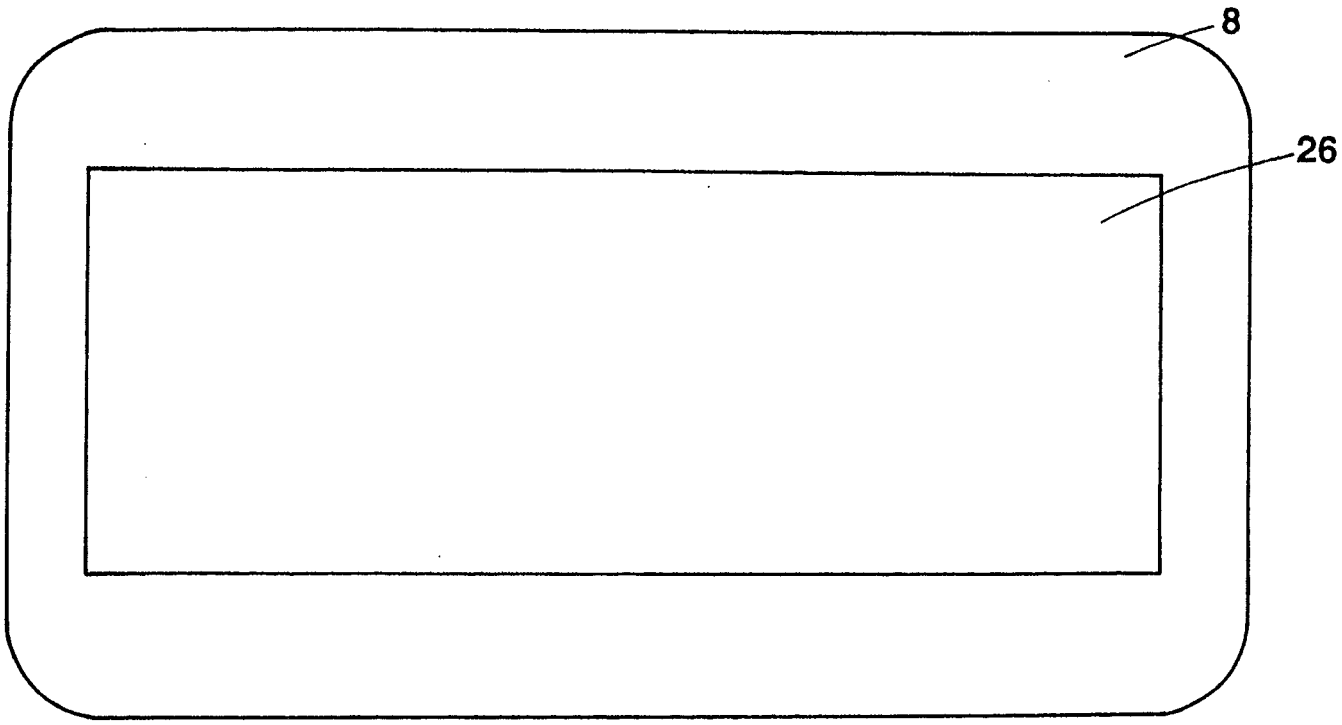
FIG. 4 is, in plan view, the bottom layer of the foundation of the present invention.

Appropriate relative dimensions of bottom layer 8 and aperture 26 are illustrated in FIG. 4.

Figure 5:
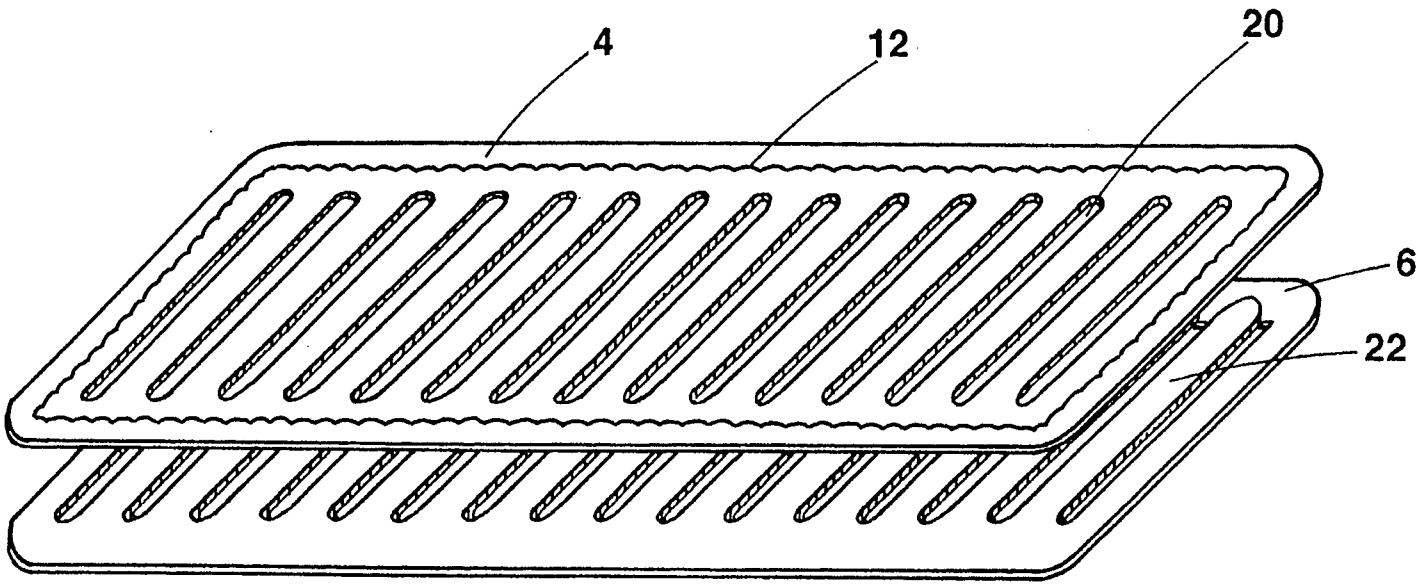
FIG. 5 is a perspective exploded view of an alternative embodiment of the foundation of the present invention.
Figure 6:
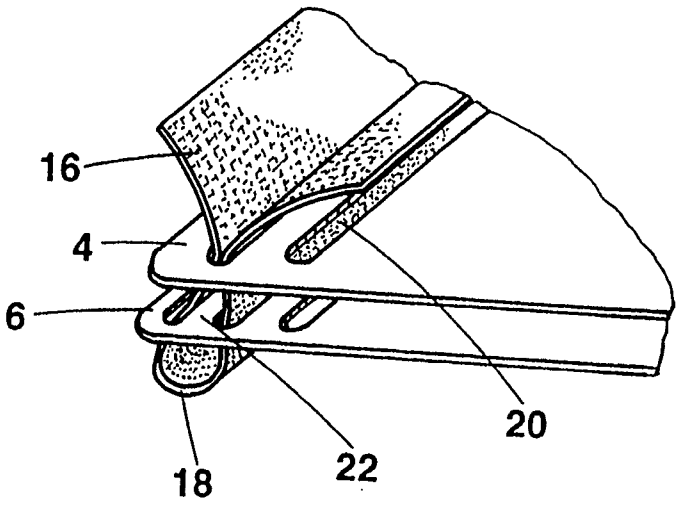
FIG. 6 is a perspective exploded partial view of the alternative embodiment illustrated in FIG. 5.

An alternative embodiment is illustrated in FIGS. 5 and 6. In this embodiment bottom layer 8 is omitted. Finger locking devices 22 are attached at one end to intermediate layer 6. Webbing 16 is wrapped around finger locking devices 22 as illustrated in FIG. 6. Again upper layer 4 and intermediate layer 6 (which is now also the bottom-most layer) are bonded together, for example by circumferential stitching 12, so as to form foundation 2.

It is understood that webbing 16 may be any resilient flexible material. It is further understood that layers 4, 6 and 8 do not have to be made of Duraflex (TM) but may be made of any other suitable semi-rigid material and that Velcro (TM) strips 10 may be replaced by any other means for detachably mounting foundation 2 to a substrate such as the interior wall of a medical kit or the interior or exterior surface of hunter's clothing.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An article holder comprising a strip of flexible material, said strip of flexible material formed into an upper loop and an opposed lower loop, a foundation piece having first and second opposed surfaces and said foundation piece having a slot extending between said first and second opposed surfaces, said slot for receiving said lower loop therethrough, whereby said lower loop may be passed through said slot so as to extend said lower loop in a locking position from said second surface and so as to position said upper loop adjacent said first surface, and locking means comprising a member having greater width than said slot, said member positioninable beneath said slot and through said lower loop for frictional engagement with said lower loop when said lower loop is in said locking position.

2. The device of claim 1 wherein said foundation piece comprises upper and lower layers, said slot extending through said upper layer, said lower layer, disposed beneath said upper layer, having a cut-out therein co-operating with said slot, said lower layer adapted to receive said member in mating engagement in said cut-out.

3. The device of claim 2 wherein said cut-out has first and second opposed ends and said member has first and second opposed ends shaped to snugly mate in corresponding said first and second opposed ends of said cut-out, said first and second opposed ends of said cut-out having shaped voids for snugly receiving said first and second opposed ends of said member therein.

4. The device of claim 3 wherein said greater width of said member than said slot is approximately in the ratio of 4 to 1.

5. The device of claim 4 wherein said member is of approximately the same thickness as said lower layer.

6. The device of claim 5 wherein said member is semi-rigid.

7. The device of claim 1 wherein said foundation piece comprises an upper layer, an intermediate layer, and a lower layer, said slot extending through said upper layer, said intermediate layer, disposed beneath said upper layer, having a first cut-out therein co-operating with said slot, said first cut-out having first and second opposed ends, said intermediate layer adapted to receive said member in mating engagement in said first cut-out, said lower layer, disposed beneath said intermediate layer so as to overlap said first and second opposed ends of said first cut-out, having a second cut-out therein co-operating with said first cut-out whereby said member maybe inserted through said second cut-out into mating engagement with said first and second opposed ends of said first cut-out.

8. The device of claim 7 wherein said member has first and second opposed ends shaped to snugly mate in corresponding said first and second opposed ends of said first cut-out, said first and second opposed ends of said first cut-out having shaped voids for snugly receiving said first and second opposed ends of said member therein.

9. The device of claim 8 wherein said greater width of said member than said slot is approximately in the ratio of 4 to 1.

10. The device of claim 9 wherein said member is of approximately the same thickness as said intermediate layer.

11. The device of claim 10 wherein said member is semi-rigid.

12. An article holder comprises a strip of flexible material, said strip of flexible material formed into an upper loop and an opposed lower loop, a foundation piece having first and second opposed surfaces and said foundation piece having a slot extending between said first and second opposed surfaces, said slot for receiving said lower loop therethrough, whereby said lower loop may be passed through said slot so as to extend said lower loop in a locking position from said second surface and so as to position said upper loop adjacent said first surface, and locking means comprising a member having greater width than said slot, said member positioned beneath said slot and mounted at a first end of said member to said foundation piece, a second end of said member opposed said first end of said member extendable through said lower loop for frictional engagement of said member with said lower loop when said lower loop is in said locking position.

13. The device of claim 12 wherein said foundation piece comprises upper and lower layers, said slot extending through said upper layer, said lower layer, disposed beneath said upper layer, having a cut-out therein co-operating with said slot, said lower layer adapted to receive said member in mating engagement in said cut-out.

14. The device of claim 13 wherein said cut-out has first and second opposed ends and said member has first and second opposed ends shaped to snugly mate in corresponding said first and second opposed ends of said cut-out, said first and second opposed ends of said cut-out having shaped voids for snugly receiving said first and second opposed ends of said member therein.

15. The device of claim 14 wherein said greater width of said member than said slot is approximately in the ratio of 4 to 1.

16. The device of claim 15 wherein said member is of approximately the same thickness as said lower layer.

17. The device of claim 16 wherein said member is semi-rigid.

18. The device of claim 12 wherein said foundation piece comprises an upper layer, an intermediate layer, and a lower layer, said slot extending through said upper layer, said intermediate layer, disposed beneath said upper layer, having a first cut-out therein co-operating with said slot, said first cut-out having first and second opposed ends, said intermediate layer adapted to receive said member in mating engagement in said first cut-out, said lower layer, disposed beneath said intermediate layer so as to overlap said first and second opposed ends of said first cut-out, having a second cut-out therein co-operating with said first cut-out whereby said member maybe inserted through said second cut-out into mating engagement with said first and second opposed ends of said first cut-out.

19. The device of claim 18 wherein said member has first and second opposed ends shaped to snugly mate in corresponding said first and second opposed ends of said first cut-out, said first and second opposed ends of said first cut-out having shaped voids for snugly receiving said first and second opposed ends of said member therein.

20. The device of claim 19 wherein said greater width of said member than said slot is approximately in the ratio of 4 to 1.

21. The device of claim 20 wherein said member is of approximately the same thickness as said lower layer.

22. The device of claim 21 wherein said member is semi-rigid.

23. An article holder comprising a strip of flexible material, said strip of flexible material formed into upper loops and opposed lower loops, a foundation piece having first and second opposed surfaces and said foundation piece having slots extending between said first and second opposed surfaces, said slots for receiving said lower loops therethrough, one of each of said lower loops through each of said slots, whereby said lower loops may be passed through said slots so as to extend said lower loops in a locking position from said second surface and so as to position said upper loops adjacent said first surface, and locking means comprising members positionable beneath said slots and through said lower loops when said lower loops are in said locking position, one member positionable beneath each of said slots and through each of said lower loops, said members having greater width than said slots for frictional engagement with said lower loops.

* * * * *